US005809388A

United States Patent [19]

Inada et al.

[11] Patent Number: 5,809,388

[45] Date of Patent: Sep. 15, 1998

[54] IMAGE FORMING APPARATUS AND FIXING DEVICE THEREFOR

[75] Inventors: Toshio Inada, Yokohama; Itsuo Ikeda, Yamato; Tsuneo Kurotori, Tokyo; Sadayuki Iwai; Yusuke Takeda, both of Yokohama, all of Japan

[73] Assignee: Ricoh Company, Ltd., Tokyo, Japan

[21] Appl. No.: 834,857

[22] Filed: Apr. 10, 1997

[30] Foreign Application Priority Data

Apr. 10, 1996 [JP] Japan ..... 8/088418

[51] Int. Cl.[6] ..... G03G 15/20

[52] U.S. Cl. ..... 399/320; 347/156; 361/225; 399/306; 399/400; 430/124

[58] Field of Search ..... 399/320, 321, 399/322, 400, 306, 307, 310, 299; 361/214, 225; 347/156; 430/124

[56] References Cited

U.S. PATENT DOCUMENTS

| | | | |
|---|---|---|---|
| 4,092,099 | 5/1978 | Chiba et al. | 399/320 X |
| 4,591,884 | 5/1986 | Miyamoto et al. | 347/156 X |
| 4,731,631 | 3/1988 | Monkelbaan et al. | 399/306 |
| 4,739,363 | 4/1988 | Hoshika et al. | 361/214 X |
| 4,825,334 | 4/1989 | Kisler | 361/225 X |
| 4,948,691 | 8/1990 | Kurotori et al. . | |
| 4,958,187 | 9/1990 | Tsuchiya et al. | 399/306 |
| 4,985,733 | 1/1991 | Kurotori et al. . | |
| 4,987,457 | 1/1991 | Mochizuki et al. . | |
| 5,099,289 | 3/1992 | Kurotori et al. . | |
| 5,142,339 | 8/1992 | Kasahara et al. | 399/322 |
| 5,402,220 | 3/1995 | Tanaka et al. . | |

FOREIGN PATENT DOCUMENTS

| | | |
|---|---|---|
| 2-212149 | 8/1990 | Japan . |
| 5-066689 | 3/1993 | Japan . |
| 8-146725 | 6/1996 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

In an image forming apparatus, a fixing device fixes a toner image transferred to a sheet, but held in an unstable state, temporarily on the sheet by a Johnson Rahbeck effect. The fixed image firmly adhere to the sheet and is free from disturbance or suffers from a minimum of disturbance.

30 Claims, 8 Drawing Sheets

IMAGE FORMING APPARATUS AND FIXING DEVICE THEREFOR

BACKGROUND OF THE INVENTION

1. Field of the Invention

The present invention relates to an image forming apparatus and, more particularly, to a fixing device therefor.

2. Discussion of the Background

An image forming process of the kind electrostatically forming a latent image on an image carrier, developing the latent image to produce a corresponding toner image, and fixing the toner image on a sheet or similar recording medium has been customary with an analog or a digital copier, optical printer, electrostatic printer or similar image forming apparatus. The prerequisite with this kind of process is that the toner image be surely fixed on the sheet; otherwise, the toner image would come off the sheet easily when physically rubbed against some member.

Generally, the latent image is developed by either one of a system using a dry or powdery developer and a system using a developing liquid. Some toner applicable to the system using a developing liquid is capable of firmly adhering to the sheet without resorting to fixation. Usually, however, the toner, whether it be dry or wet, must be fixed by fusion. Even the toner not needing fixation remains unstable until a toner image formed on the sheet has been dried and firmly adhered to the sheet. During this period, it is likely that the toner image is disfigured.

SUMMARY OF THE INVENTION

It is therefore an object of the present invention to provide a fixing device capable of surely fixing a toner image on a recording medium.

It is another object of the present invention to provide an image forming unit including a fixing device capable of surely fixing a toner image on a recording medium.

In accordance with the present invention, a method of fixing a toner image on a recording medium fixes the toner image by using a Johnson Rahbeck effect.

Also, in accordance with the present invention, a method of fixing a toner image formed on a recording medium includes the steps of fixing the toner image temporarily on the recording medium by using the Johnson Rahbeck effect, and fixing the toner image on the recording medium by fusion.

Further, in accordance with the present invention, a device of fixing a toner image on a recording medium has at least one preliminary fixing section arranged on a sheet transport path, for fixing a toner image temporarily on the recording medium by the Johnson Rahbeck effect, and a fixing section for fixing at least one toner image undergone preliminary fixation by fusion.

Moreover, in accordance with the present invention, an image forming unit includes an image carrier. A latent image forming section electrostatically forms a latent image on the image carrier in accordance with image data. A developing section develops the latent image to thereby produce a corresponding toner image. A transferring section transfers the toner image from the image carrier to a recording medium. A preliminary fixing section fixes the toner image temporarily on the recording medium by the Johnson Rahbeck effect.

BRIEF DESCRIPTION OF THE DRAWINGS

The above and other objects, features and advantages of the present invention will become apparent from the following detailed description taken with the accompanying drawings in which.

In the drawings, identical reference numerals designate identical structural elements.

DESCRIPTION OF THE PREFERRED EMBODIMENTS

The principle of the present invention will be described first. A fixing method of the present invention is characterized in that it fixes a toner image on a sheet or similar recording medium by using a Johnson Rahbeck effect. Assume that fine conductive particles are carried on a support in a layer, and that a current is forced to flow through the layer and support in the thicknesswise direction. Then, a noticeable voltage drop occurs at the interface between the support and the layer and the interface between the particles within the layer due to contact resistance, forming electric double layers at the interfaces. As a result, the support and particles and the particles themselves firmly adhere to each other due to electrostatic forces. This phenomenon is referred to as the Johnson and Rahbeck effect.

Figure 1A:
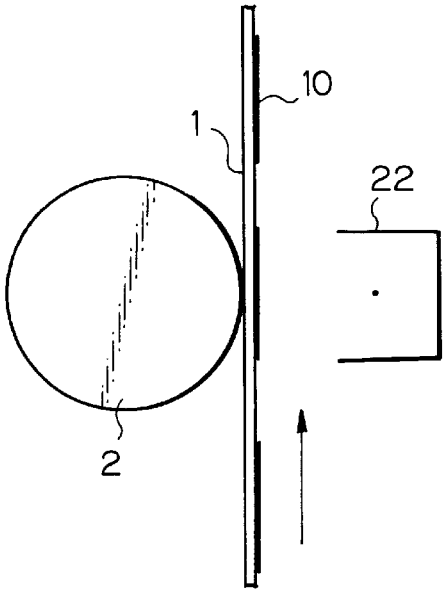
FIGS. 1A and 1B are views for describing the principle of the present invention and a fixing method embodying the present invention.
Figure 1B:
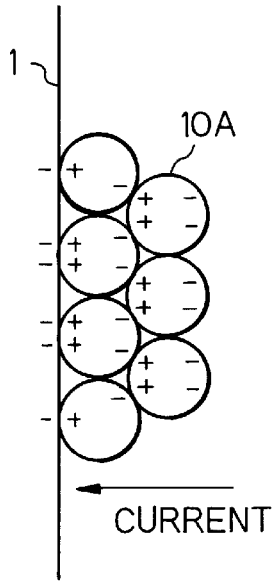

As shown in FIG. 1A, assume that a conductive roller or counter electrode 2 contacts the rear of a sheet or support 1 carrying a toner image 10 on its front on a sheet transport path, and that a corona charger 22 effects corona discharge in front of the sheet 1. Then, a current is forced to flow in the widthwise direction of the sheet 1 via the toner image 10. Consequently, as FIG. 1B models, positive and negative charges accumulate at the interface between toner or fine particles 10A and the sheet 1 and the interface between the fine particles 10A. This causes intense electrostatic coupling forces to act between the particles 10A and between the particles 10A and the sheet 1. As a result, the particles 10A intensely cohere and firmly adhere to the sheet 1. This can be used to fix the toner image 10 on the sheet 1. Even when the toner image 10 is formed by a developing liquid consisting of toner and a dielectric liquid, the Johnson Rahbeck effect is also available.

If the volume resistivity of the support and that of the toner are low, the above charges cancel each other and disappear in a short period of time, causing the adhesion based on the Johnson and Rahbeck effect to be lost. However, because the sheet and toner usually have a volume resistivity as high as $10^{-8}$ Ωcm to $10^{-12}$ Ωcm each, the adhesion and cohesion based on the Johnson and Rahbeck effect continues over a relatively long period of time.

Even when the toner image is formed on the sheet by the toner of a developing liquid not needing fixation, as mentioned earlier, it can be fixed on the sheet by the Johnson and Rahbeck effect. Specifically, when the toner image formed by such a kind of toner is fixed on the sheet, the intense adhesion derived from the above effect obviates disturbance to the image and other defects while the toner image is unstable, i.e., until it firmly adheres to the sheet due to the evaporation and drying of the liquid.

When the toner, whether it be wet or dry, forming the toner image on the sheet needs fixation, it may be sequentially fixed by a preliminary fixing step using the Johnson and Rahbeck effect and a fixing step using fusion.

Assume that a plurality of toner images are sequentially formed on a single sheet one above the other, as in a multicolor mode, color mode, or image combination mode. Then, the preliminary fixing step using the Johnson and Rahbeck effect may be executed every time one toner image is formed on the sheet. In such a case, after the last toner image has undergone preliminary fixation, all the toner images will be collectively fixed by fusion; that is, the fixation may be implemented as one or more preliminary fixing steps and a single fixing step or fusing step. This can be done with any one of the dry toner and wet toner.

Some different configurations are available for achieving the Johnson and Rahbeck effect, as follows. In a first configuration, a conductive electrode is held in contact with the rear of a sheet carrying a toner image on its front, while a conductive roller is held in contact with the front of the sheet. In this condition, a current is caused to flow between the conductive electrode and the conductive roller. In a second configuration, while the conductive electrode is held in contact with the rear of the sheet, corona discharge is effected at the front of the sheet. In a third configuration, while the conductive electrode is held in contact with the rear of the sheet, a conductive roller is located in the vicinity of, but at a distance from, the front of the sheet; a current is caused to flow between the conductive electrode and the conductive roller via a gap. In a fourth configuration, while the conductive electrode is held in contact with the rear of the sheets, an array of conductive needle electrodes are located in the vicinity of, but at a distance from, the front of the sheet; a current is caused to flow between the conductive electrode and the array via a gap. In a fifth configuration, while the conductive electrode is held in contact with the rear of the sheet, the edge of a conductive flat electrode having a wedge-like cross-section is located in the vicinity of, but at a distance from, the front of the sheet; a current is caused to flow between the conductive electrode and the flat electrode via a gap. In a sixth configuration, while the conductive electrode is held in contact with the rear of the sheet, the end of a conductive brush is located in the vicinity of, but at a distance from, the front of the sheet; a current is caused to flow between the conductive electrode and the conductive brush via a gap. The current may be derived from any one of an AC voltage, DC voltage and AC-biased DC voltage.

To form the toner image on the sheet, the toner image formed on the image carrier may be transferred to the sheet either directly or by way of an intermediate transfer medium. Alternatively, the latent image may be transferred to the sheet and then developed. Further, the latent image may be directly formed on the sheet by, e.g., selective charging using an array of needle electrodes, and then developed.

FIG. 1A shows a fixing method in accordance with the present invention. As shown, a conductive electrode in the form of a roller 2 contacts and rolls on the rear of a sheet 1 carrying a toner image 10 on its front and being conveyed along a preselected path. A corona charger 22 charges the sheet 1 at the front side by corona discharge, so that a current is forced to flow in the thicknesswise direction of the sheet 1 via the toner image 10. As a result, the toner image 10 is firmly adhered to the sheet 1 by the Johnson Rahbeck effect. As long as toner particles constituting the toner image 10 are of the kind not needing fusion, the above adhesion suffices. Specifically, during an unstable period up to the time when the toner image 10 firmly adheres to the sheet 1 due to drying, the Johnson Rahbeck effect insures the adhesion of the image 10 to the sheet 1 and thereby obviates disturbance to the image 10 and other defects effectively. A usual non-coated sheet used as a recording medium has gaps of about several ten microns between fibers, as measured on its surface. The non-coated sheet has a volume resistivity of about $10^{-8}$ Ωcm to $10^{-12}$ Ωcm, as stated earlier. Further, the toner has a particle size of several microns to several ten microns. Under these conditions, the Johnson Rahbeck effect is exhibited to a desirable extent.

Figure 2:
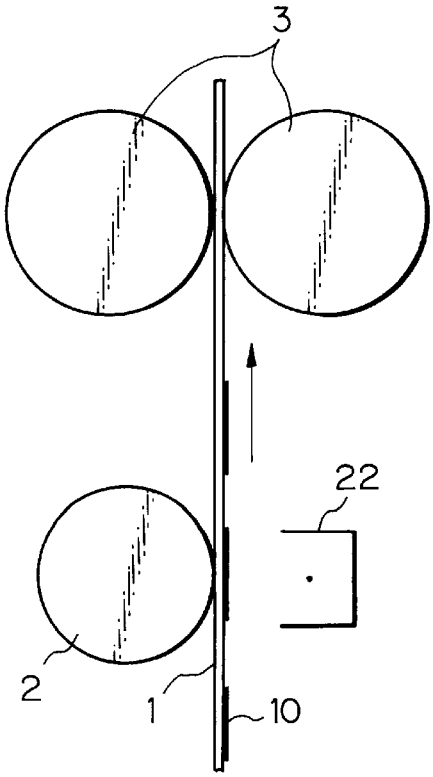
FIGS. 2, 3A and 3B show a fixing device also embodying the present invention.

FIG. 2 shows a basic arrangement of a fixing device embodying the present invention. As shown, the conductive roller 2 and corona charger 22 face each other with the intermediary of the sheet 1, and operate in the manner described with reference to FIG. 1A. The roller 2 and corona charger 22 constitute a preliminary fixing section. With the corona charger 22, it is possible to causes a current to flow uniformly in the widthwise direction of the sheet 1, i.e., the direction parallel to the sheet surface and perpendicular to the direction of sheet feed indicated by an arrow in FIG. 2.

A pair of rollers 3 are positioned downstream of the cooperative roller 2 and corona charger 22 in the direction of sheet transport. The rollers 3 constitute a fixing section in combination and convey the sheet 1 by nipping it therebetween. One roller 3 contacting the front of the sheet 1 is a heat roller while the other roller 3 contacting the rear of the sheet 1 is a press roller. The rollers 3 heat and press the sheet 1 and toner image 10 carried thereon, thereby fixing the image 10 on the sheet 1 by fusion. Any suitable conventional means, not shown, may be used to convey the sheet 1.

When an image carrier is implemented as a photoconductive drum, the fixing section following the preliminary fixing section cannot, in many cases, be located in the vicinity of the drum. In such a case, the sheet 1 with the toner image 10 is often conveyed over a substantial distance between an image transfer section to the fixing section. In this condition, it is likely that the unstable toner image is disfigured due to, e.g., its contact with various members while the sheet 1 is conveyed over the above distance. The preliminary fixing section shown in FIG. 2 fixes the toner image 10 temporarily on the sheet and thereby reduces or obviates the disturbance to the toner image 10 effectively.

Figure 3A:
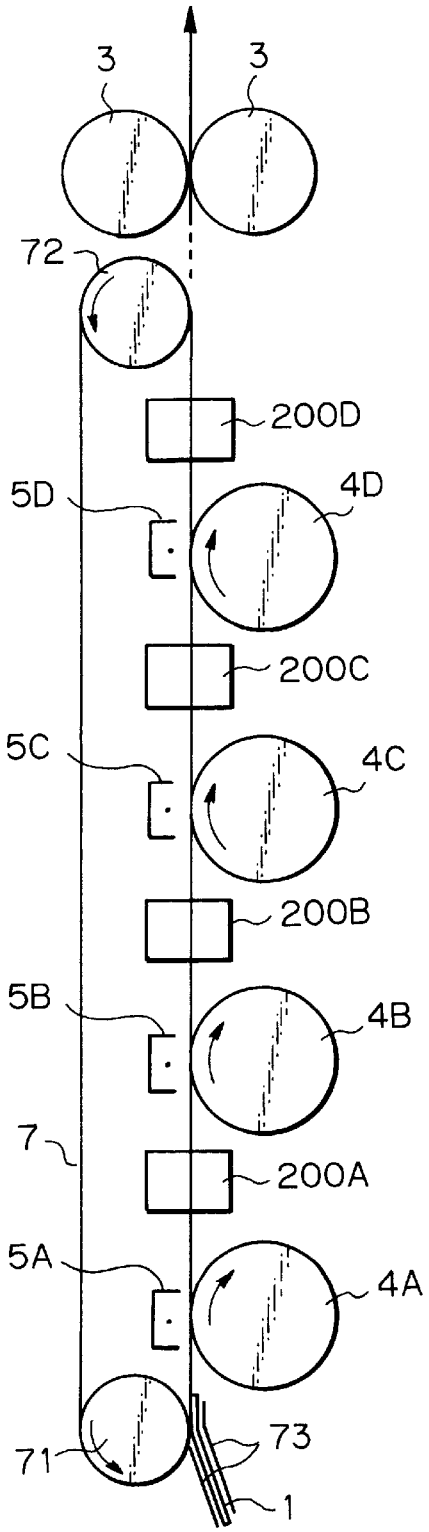
Figure 3B:
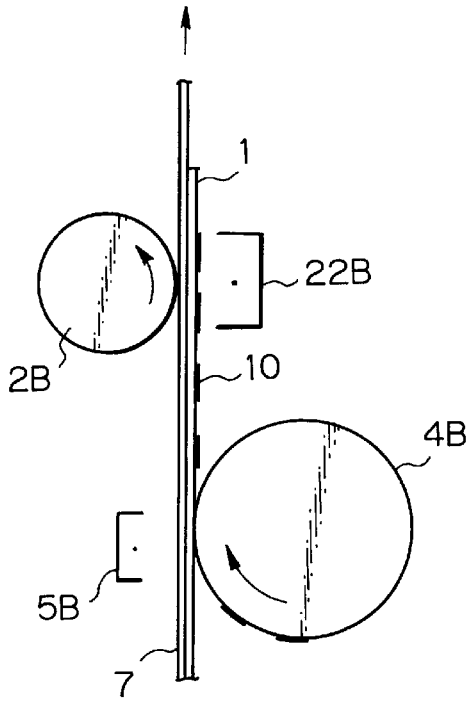

FIGS. 3A and 3B show the basic configuration of another embodiment of the present invention. As shown in FIG. 3A, the embodiment includes a transfer belt 7 implemented by an about several ten microns thick film of polyester or similar resin. The transfer belt 7 forms a part of a sheet transport path. The sheet 1 is guided by guides 73 toward the belt 7 from below the belt 7, as viewed in FIG. 3A. When the sheet 1 touches down at the lower end portion of the right run of the belt 7, as viewed in FIG. 3A, the belt 7 guides the sheet 1 upward. The belt 7 is passed over a driven pulley 71 and a drive pulley 72. The drive pulley 72 is rotated counterclockwise, as viewed in FIG. 3A, in order to drive the belt 7 counterclockwise. Photoconductive drums or image carriers 4A, 4B, 4C and 4D are sequentially arranged from the bottom to the top, as viewed in FIG. 3A, at predetermined intervals at the right-hand side of the belt 7. Transfer chargers 5A, 5B, 5C and 5D are respectively located to face the drums 4A, 4B, 4C and 4D with the intermediary of the belt 7.

Four preliminary fixing sections 200A, 200B, 200C and 200D are sequentially arranged along the belt or sheet transport path 7. The preliminary fixing sections 200A–200D are respectively positioned downstream of the drums 4A–4D with respect to the direction in which the belt 7 runs. The heat roller 3 and press roller 3 constituting the fixing section are located in the vicinity of the upper end of the belt 7. Because the preliminary fixing sections 200A–200D are identical in construction, let the following description concentrate on the section 200B by way of example. As shown in FIG. 3B, the preliminary fixing section 200B has a conductive roller or electrode 2B and a corona charger 22B. The conductive roller 2B rolls on the rear of the belt 7 while the corona charger 22B faces the roller 2B with the intermediary of the belt 7.

When the sheet 1 touches down at the belt 7, the belt 7 conveys the sheet 1 to a first image transfer position where a transfer charger 5A is located. The transfer charger 5A transfers a magenta toner image from the drum 4A to the sheet 1. Then, the preliminary fixing section 200A fixes the toner image temporarily on the sheet 1 by the Johnson Rahbeck effect. When the sheet 1 is brought to a second image transfer position by the belt 7, a cyan toner image is transferred from the drum 4B to the sheet 1 over the magenta toner image. Subsequently, as shown in FIG. 3B, the corona charger 22B included at the second preliminary fixing section 200B fixes the cyan toner image on the sheet 1 by corona discharge. In the same manner, a yellow toner image is transferred from the image carrier 4C to the sheet 1 at a third image transfer position, and is then temporarily fixed by the third preliminary fixing section 200C.

Finally, a black toner image is transferred from the drum 4D to the sheet at a fourth image transfer position, and is then temporarily fixed by the fourth preliminary fixing section 200D. Thereafter, the sheet 1 is separated from the belt 7 and has its composite or color toner image fixed thereon by the rollers or fixing section 3.

In the illustrative embodiment, a current for the preliminary fixation is caused to flow through the belt 7. In this respect, the belt 7 should preferably be formed of a material having a medium resistance, i.e., $10^{13}$ Ωcm or below.

This embodiment is advantageous over the conventional fixing system fixing a toner image by fusion every time it is transferred at each of the first to fourth image transfer positions, as follows. Because the conventional system repeats fusion four consecutive times, it needs a great amount of energy for fixation. By contrast, the embodiment effects fusion only once for four consecutive times of image transfer, needing a minimum of energy for fixation.

Moreover, fusion effected for each image transfer is apt to disfigure the image due to pressure. In the illustrative embodiment, the preliminary fixation causes no members to contact the image, and therefore reduces the disturbance to the image effectively. In addition, in the conventional system, the water content of the sheet varies due to fusion and makes it difficult to control image transfer parameters at the subsequent image transfer stage.

It is to be noted if the fourth image transfer position assigned to the drum 4D is brought closer to the roller pair or fixing section 3, the fourth preliminary fixing section 200D is omissible.

Figure 4:
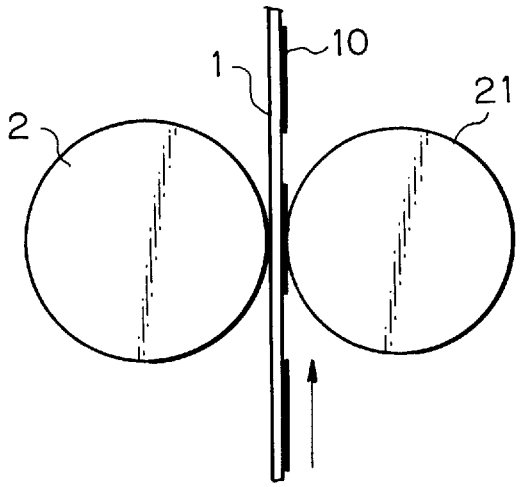
FIGS. 4–8 show embodiments of the fixing method of the present invention.

Reference will be made to FIGS. 4–11 for describing other alternative embodiments of the present invention. As shown in FIG. 4, the conductive roller or electrode 2 rolls on the rear of the sheet 1 being conveyed while another conductive roller 21 rolls on the front of the sheet 1 carrying the toner image 10. A current is caused to flow between the two rollers 2 and 21 in order to cause the Johnson Rahbeck effect to occur. In this case, a part of the toner deposits on the roller 21 contacting the front of the sheet 1. In order to reduce the toner to deposit on the roller 21 and to facilitate the removal of such toner, it may be desirable to form the roller 21 of a material having low surface energy and/or to clean the roller 21 by use of a blade, urethan roller or similar cleaning means.

Figure 5:
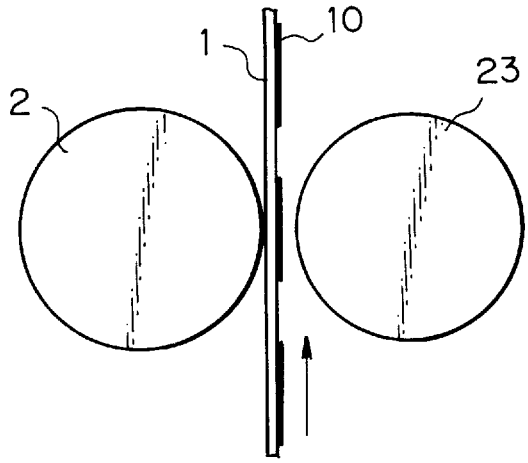

The embodiment shown in FIG. 5 is similar to the embodiment of FIG. 4 except that a conductive roller 23 is substituted for the conductive roller 21. As shown, the roller 23 is spaced from the sheet 10 being conveyed. A current is caused to flow between the rollers 2 and 23 via the gap existing between them, causing the Johnson Rahbeck effect to occur. Because the roller 23 does not contact the toner image, it does not disturb the toner image at all in the event of preliminary fixation.

Figure 6:
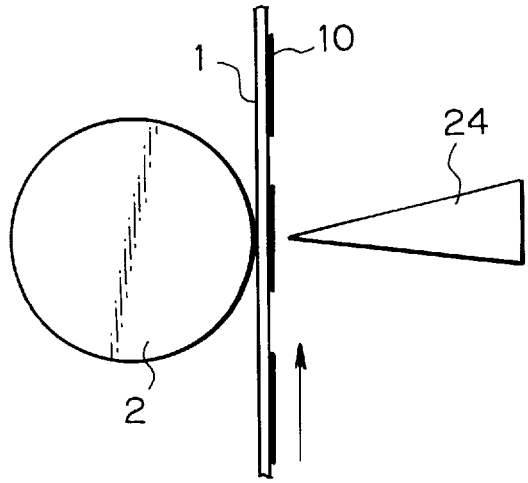

The embodiment shown in FIG. 6 is similar to the embodiment of FIG. 5 except that conductive needle electrodes 24 (only one is visible) are substituted for the roller 23. The needle electrodes 24 are arranged in an array in the widthwise direction of the sheet 1, i.e., perpendicularly to the sheet surface of FIG. 6. The tips of the needle electrodes 24 are spaced from the sheet 1 being conveyed. A current is caused to flow between the conductive roller 2 and the needle electrode array 24 via the gap existing between them, causing the Johnson Rahbeck effect to occur.

Figure 7:
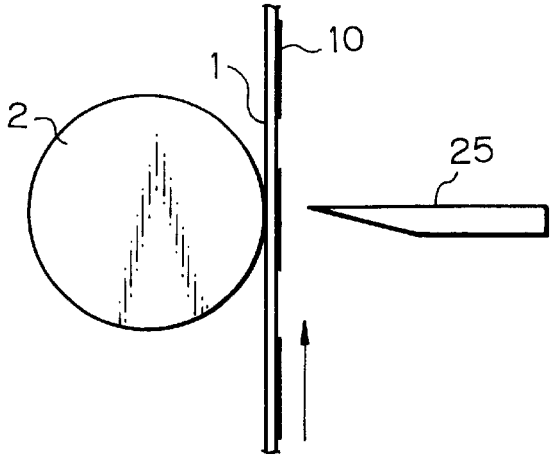

In the embodiment shown in FIG. 7, a conductive flat electrode 25 having a wedge-like cross-section has its edge located in the vicinity of, but spaced from, the sheet 10 being conveyed. A current is caused to flow between the roller 2 and the electrode 25 via the gap existing between them, causing the Johnson Rahbeck effect to occur.

Figure 8:
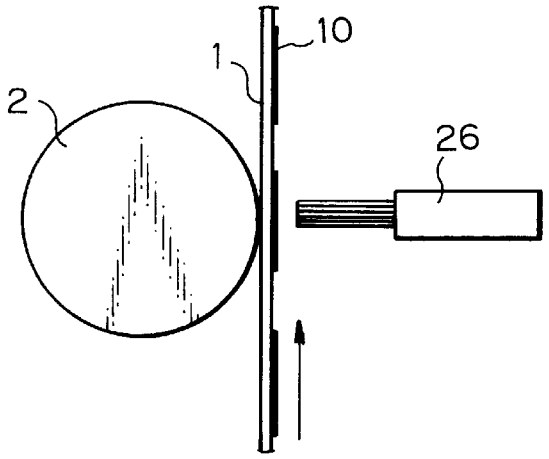

Further, in the embodiment shown in FIG. 8, a conductive brush 26 faces the front of the sheet 1 such that its end adjoins the front of the sheet 1 at a preselected distance. A current is caused to flow between the conductive roller 2 and the brush 26 via the gap existing between them, causing the Johnson Rahbeck effect to occur.

The needle electrode array 24 of FIG. 6, the flat electrode 25 of FIG. 7 and the conductive brush 26 of FIG. 8 each has a simple configuration and can be implemented at low cost.

Figure 9:
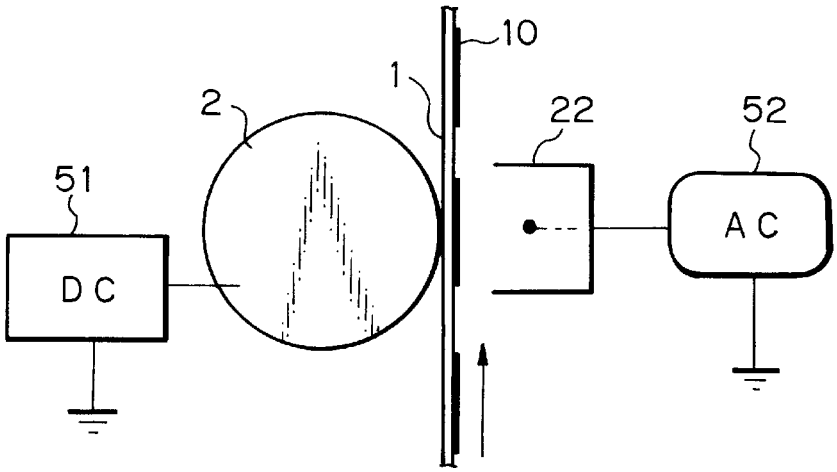
FIGS. 9–11 show other embodiments of the fixing device of the present invention.
Figure 10:
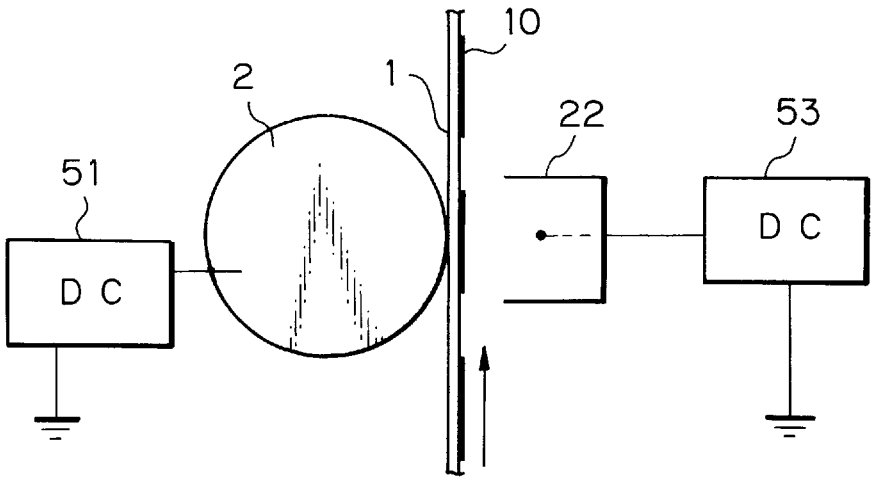
Figure 11:
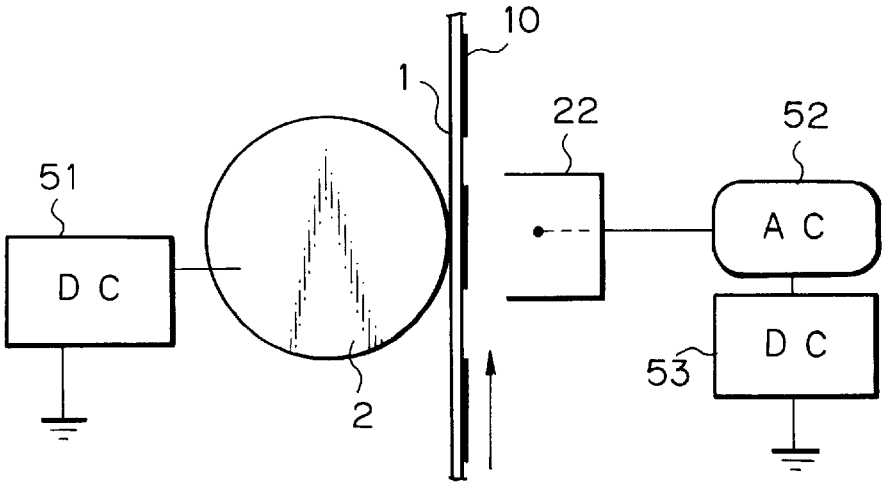

Referring to FIGS. 9–11, specific fixing devices for practicing the methods described with reference to FIGS. 1A, 1B, 2, 3A and 3B will be described. The device shown in FIG. 9 is usable when the current for causing the Johnson Rahbeck effect to occur is derived from an AC voltage. As shown, a DC voltage source 51 applies a DC voltage to the conductive roller 2 while an AC voltage source 52 applies an AC voltage to the corona charger 22. The conductive roller 2 may be connected to ground in order to omit the AC power source 51. However, the AC voltage applied to the roller 2 allows the potential of the toner image 10 formed on the sheet 1 to be controlled. This obviates, when the fixing device is followed by an image transferring step, reverse transfer of the toner from the sheet 1 to an image carrier or an intermediate transfer body during the image transferring step. Assume that the conductive roller 21 or 23, needle electrode array 24, flat electrode 25 or conductive brush 26 is located at the front of the sheet 1. Then, an AC voltage and a DC bias voltage (including ground potential) may be respectively applied to the conductive roller 2 and the electrode facing the toner image (e.g. roller 21 or 23).

The device shown in FIG. 10 is usable when the current for causing the Johnson Rahbeck effect to occur is derived from a DC voltage. As shown, a DC voltage source 53 applies a DC voltage to the corona charger 22 while the DC voltage source 51 applies the DC voltage to the conductive roller 2. Again, the conductive roller 2 may be connected to ground in order to omit the AC power source 51. However, the AC voltage applied to the roller 2 allows the load of the voltage source to be adjusted or reduced effectively. Assume that the conductive roller 21 or 23, needle electrode array 24, flat electrode 25 or conductive brush 26 is located at the front of the sheet 1. Then, an AC voltage and a DC bias voltage (including ground potential) may be respectively applied to the conductive roller 2 and the electrode facing the toner image (e.g. roller 21 or 23). When only a DC voltage is used to force a current to flow, as shown and described, the potential of the toner image 10 can be controlled with ease. Therefore, the polarity of the toner image 10 which has undergone preliminarily fixation may be so controlled as to obviate reverse transfer at the next image transfer position (assuming that image transfer is effected twice or more).

The device shown in FIG. 11 is usable when the current for causing the Johnson Rahbeck effect to occur is derived from an AC biased DC voltage. As shown, the AC voltage output from the AC voltage source 52 is superposed on the DC voltage output from the DC voltage source 53 and then applied to the corona charger 22. The DC voltage source 51 applies the DC voltage to the conductive roller 21, as in the previous arrangements. Again, the conductive roller 2 may be connected to ground in order to omit the AC power source 51. However, the AC voltage applied to the roller 2 allows the load of the voltage source to be adjusted or reduced effectively. Further, the AC biased DC voltage is used to force a current to flow, as shown and described, the potential of the toner image 10 can also be controlled with ease. Therefore, the polarity of the toner image 10 which has undergone preliminarily fixation may be so controlled as to obviate reverse transfer at the next image transfer position (assuming that image transfer is effected twice or more).

Figure 12:
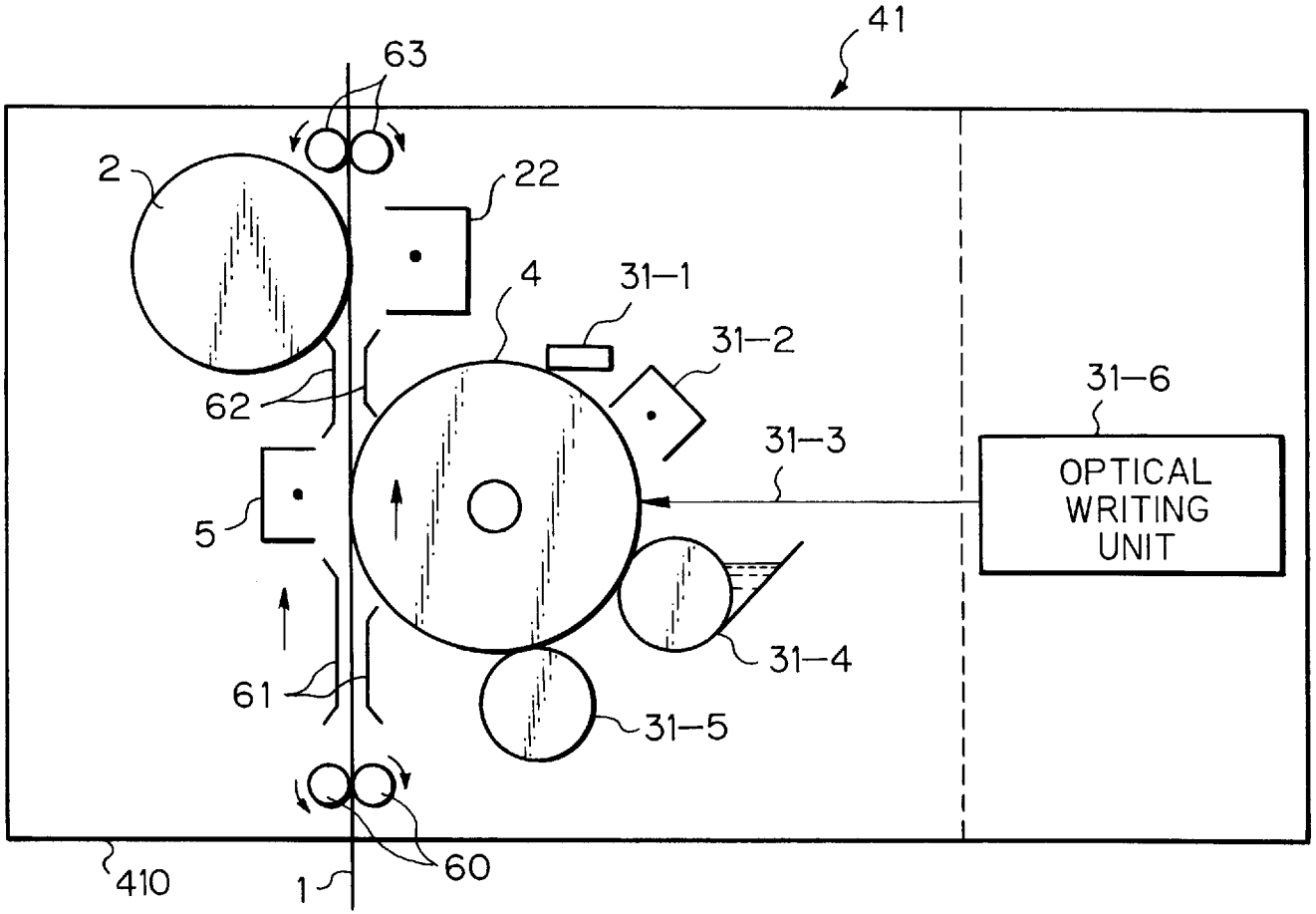
FIG. 12 shows an image forming unit also embodying the present invention.

Referring to FIG. 12, an image forming unit also embodying the present invention is shown. As shown, the image forming unit, generally 41, includes a photoconductive drum or image carrier 4. Latent image forming means has a cleaning blade 31-1, a charger 31-2, and an optical writing unit 31-6. Developing means has a developing device 31-4 storing a developing liquid, and a squeeze roller 31-5. Image transferring means is constituted by a transfer charger 5. Preliminary fixing means consists of the conductive roller 2 and corona charger 22. Conveying means conveys the sheet 1 by way of the fixing section and preliminary fixing section. The conveying means includes conveyor rollers 60 and 63 and guides 61 and 62. A casing 410 accommodates the above structural members.

While the drum 4 is rotated counterclockwise, as viewed in FIG. 12, the cleaning blade 31-1 cleans the surface of the drum 4. The charger 31-2 charges the cleaned surface of the drum 4 uniformly. The writing unit 31-6 optically scans with a beam 31-3 the charged surface of the drum 4 in order to form a latent image thereon. The developing device 31-4 develops the latent image with the developing liquid so as to produce a corresponding toner image. The squeeze roller 31-5 removes any excessive part of the developing liquid.

When the sheet 1 is introduced into the casing 410, the conveyor rollers 60 and guides 61 drive the sheet 1 to an image transfer position. At this position, the transfer charger transfers the toner image from the drum 4 to the sheet 1. The guides 62 guide the sheet 1 coming out of the image transfer position to the preliminary fixing means or preliminary fixing position where the conductive roller 2 and corona charger 22 are located. After the toner image has been fixed temporarily on the sheet 1 at the above position, the sheet 1 is driven out of the casing 410 by the rollers 63.

Figure 13:
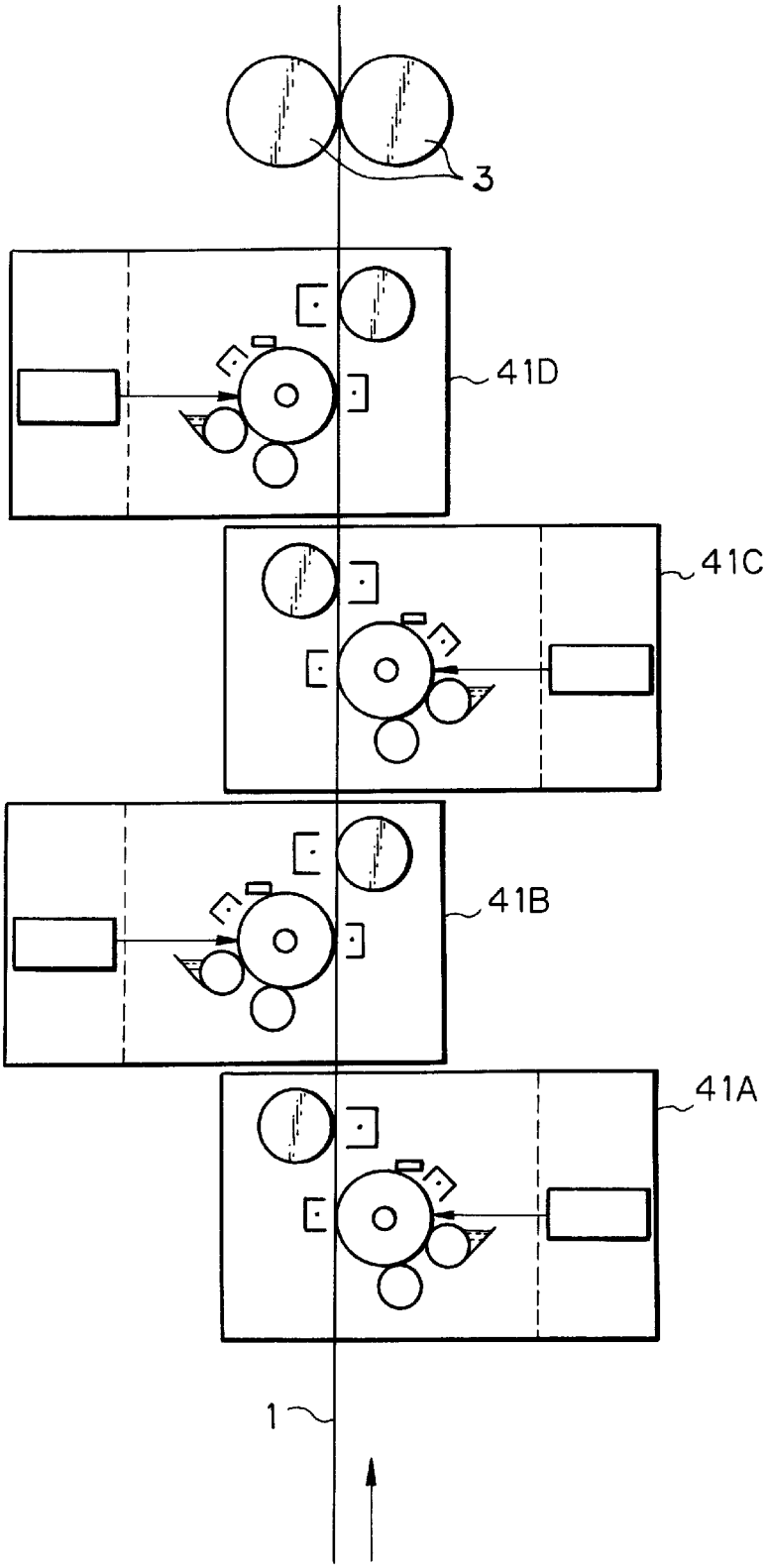
FIGS. 13 and 14 show image forming apparatuses also embodying the present invention.

FIG. 13 shows an image forming apparatus also embodying the present invention and implemented as a bicolor image forming apparatus operable in a duplex or two-side mode. As shown, image forming units 41A, 41B, 41C and 41D are sequentially arranged along the sheet transport path. The heat roller 3 and press roller 3 constitute the fixing section using fusion, and fix the toner image on the sheet 1 coming out of the last image forming unit 41D. Toner images are alternately formed on the front and the rear of the sheet 1 by the image forming units 41A-41D. The sheet 1 coming out of the image forming unit 4D carries bicolor toner images on both sides thereof and has the toner images fixed by the fixing section 3.

Figure 14:
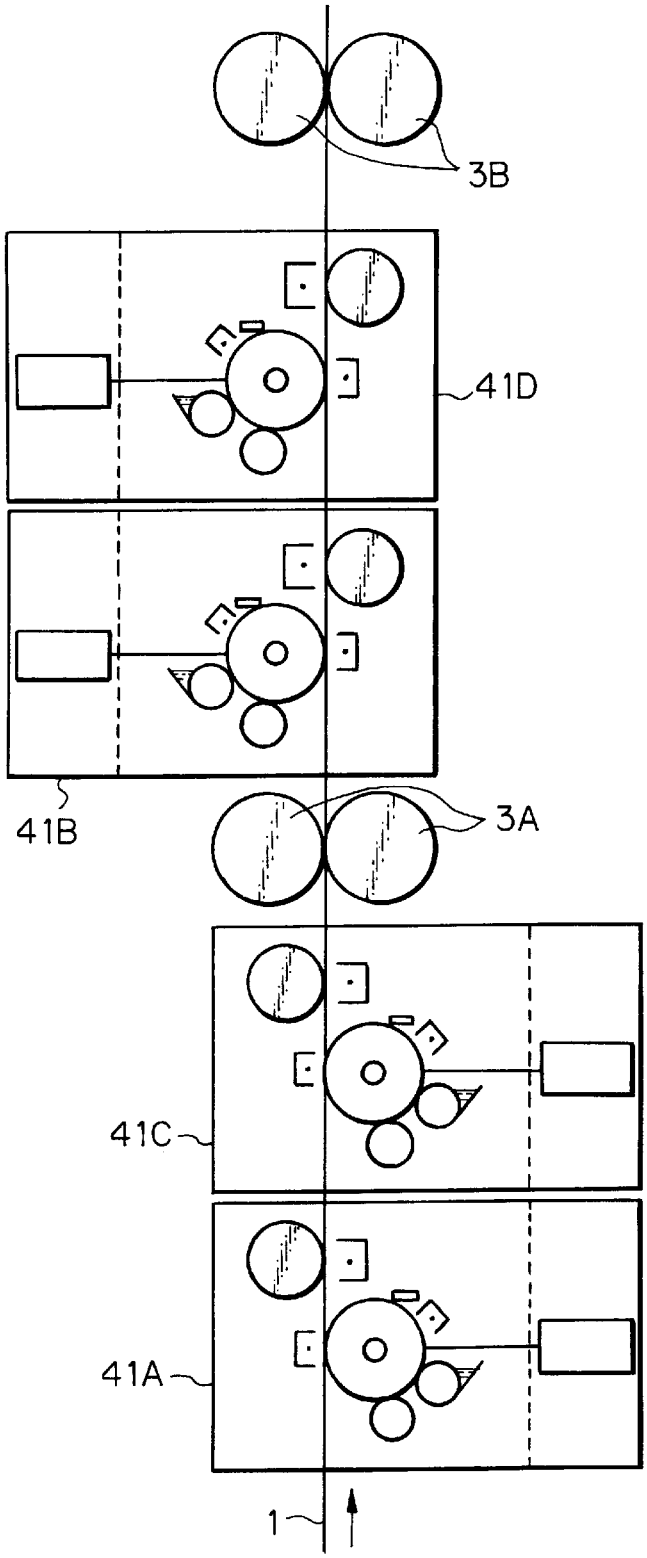

FIG. 14 shows another embodiment of the image forming apparatus in accordance with the present invention and also implemented as a bicolor image forming apparatus operable in a duplex mode. As shown, two image forming devices are arranged one after the other along the sheet transport path. One image forming device consists of the image forming units 41A and 41C and a fixing section implemented by a pair of rollers 3A. The other image forming device consists of the image forming units 41B and 41D and a fixing section implemented by a pair of rollers 3B. In operation, the image forming units 41A and 41C form a bicolor toner image on one side or front of the sheet 1 in a preliminarily fixed state. Then, the rollers 3A fix the bicolor toner image on the sheet 1 by fusion. Subsequently, the other image forming units 41B and 41D form a bicolor toner image on the other side or rear of the sheet 1 also in a preliminarily fixed state, and then the rollers 3B fix it on the sheet 1 by fusion.

Of course, the four image forming units may be so located as to face the front of the sheet 1 in order to form a color image on the sheet 1. Alternatively, one image forming unit may be located at each of the front and rear of the sheet 1 and operated in a monocolor duplex mode. In this manner, a suitable number of image forming units may be arranged at one side or both sides of the sheet 1, as desired. Also, an optical writing unit associated with each image forming unit may be implemented as an independent unit.

In the embodiments shown and described, the image forming units include conveying means. Alternatively, in the case where a recording medium in the form of a webbing is paid out from a roll and cut at a preselected length when driven out of the apparatus, independent conveying means may be provided, in which case the conveying means of the image forming units is not essential.

While the foregoing embodiments have concentrated on a developing device using a developing liquid, the present invention is, of course, practicable with various kinds of dry developers. When a toner image is formed on a sheet by a developing liquid, the fixation using the Johnson Rahbeck effect enhances the degree of oil supply to the sheet due to forced current flow and thereby promotes the solidification of the toner image, as determined by experiments. It will therefore be seen that the method of the present invention stabilizes a temporarily fixed toner image particularly when the toner image is formed by a developing liquid.

In summary, in accordance with the present invention, a toner image transferred to a sheet, but held in an unstable state, can firmly adhere to the sheet due to the Johnson Rahbeck effect and is free from disturbance or suffers from a minimum of disturbance.

Various modifications will become possible for those skilled in the art after receiving the teachings of the present disclosure without departing from the scope thereof.

What is claimed is:

1. A method of fixing a toner image on a recording medium by using a Johnson Rahbeck effect, wherein the Johnson Rahbeck effect is provided by a conductive electrode contacting a rear of the recording medium carrying the toner image on a front and an array of conductive needle electrodes adjoining, but spaced from, said front such that a current flows between said conductive electrode and said array via a gap.

2. A method as claimed in claim 1, wherein the current is derived from one of an AC voltage, a DC voltage, and an AC biased DC voltage.

3. A method as claimed in claim 1, wherein the toner image is formed on the recording medium by a developing liquid.

4. A method of fixing a toner image on a recording medium by using a Johnson Rahbeck effect, wherein the Johnson Rahbeck effect is provided by a conductive electrode contacting a rear of the recording medium carrying the toner image on a front and a conductive flat electrode having a wedge-like cross section, and wherein an edge of said flat electrode adjoins, but is spaced from, said front such that a current flows between said conductive electrode and said flat electrode via a gap.

5. A method as claimed in claim 4, wherein the current is derived from one of an AC voltage, a DC voltage, and an AC biased DC voltage.

6. A method as claimed in claim 4, wherein the toner image is formed on the recording medium by a developing liquid.

7. A method of fixing a toner image formed on a recording medium, comprising the steps of:

(a) fixing the toner image temporarily on the recording medium by using a Johnson Rahbeck effect; and (b) fixing the toner image on the recording medium by fusion;

wherein step (a) comprises (c) causing a conductive electrode to contact a rear of the recording medium carrying the toner image on a front, (d) locating an array of conductive needle electrodes in the vicinity of, but at a distance from, said front, and (e) causing a current to flow between said conductive electrode and said array via a gap, whereby the Johnson Rahbeck effect is provided.

8. A method as claimed in claim 7, wherein the toner image is formed on the recording medium by one of development using a developing liquid or development using a dry developer.

9. A method as claimed in claim 7, wherein in step (e) the current is derived from one of an AC voltage, a DC voltage, and an AC biased DC voltage.

10. A method of fixing a toner image formed on a recording medium, comprising the steps of:

(a) fixing the toner image temporarily on the recording medium by using a Johnson Rahbeck effect; and (b) fixing the toner image on the recording medium by fusion;

wherein step (a) comprises (c) causing a conductive electrode to contact a rear of the recording medium carrying the toner image on a front, (d) locating an edge of a conductive flat electrode having a wedge-like cross-section in the vicinity of, but at a distance from, said front, and (e) causing a current to flow between said conductive electrode and said flat electrode via a gap, whereby the Johnson Rahbeck effect is provided.

11. A method as claimed in claim 10, wherein the toner image is formed on the recording medium by one of development using a developing liquid or development using a dry developer.

12. A method as claimed in claim 10, wherein in step (e) the current is derived from one of an AC voltage, a DC voltage, and an AC biased DC voltage.

13. A method of fixing a plurality of toner images sequentially formed on a single recording medium, comprising the steps of:

(a) fixing, by using a Johnson Rahbeck effect, each toner image temporarily on the recording medium every time the toner image is formed on the recording medium; and (b) fixing, after fixing a last toner image temporarily, all toner images on the recording medium by fusion;

wherein step (a) comprises (c) causing a conductive electrode to contact a rear of the recording medium carrying the toner image on a front, (d) locating an array of conductive needle electrodes in the vicinity of, but at a distance from, said front, and (e) causing a current to flow between said conductive electrode and said array via a gap, whereby the Johnson Rahbeck effect is provided.

14. A method as claimed in claim 13, wherein in step (e) the current is derived from one of an AC voltage, a DC voltage, and an AC biased DC voltage.

15. A method as claimed in claim 13, wherein the toner image is formed on the recording medium by one of development using a developing liquid or development using a dry developer.

16. A method of fixing a plurality of toner images sequentially formed on a single recording medium, comprising the steps of:

(a) fixing, by using a Johnson Rahbeck effect, each toner image temporarily on the recording medium every time the toner image is formed on the recording medium; and (b) fixing, after fixing a last toner image temporarily, all toner images on the recording medium by fusion;

wherein step (a) comprises (c) causing a conductive electrode to contact a rear of the recording medium carrying the toner image on a front, (d) locating an edge of a conductive flat electrode having a wedge-like cross section in the vicinity of, but at a distance from, said front, and (e) causing a current to flow between said conductive electrode and said flat electrode via a gap, whereby the Johnson Rahbeck effect is provided.

17. A method as claimed in claim 16, wherein in step (e) the current is derived from one of an AC voltage, a DC voltage, and an AC biased DC voltage.

18. A method as claimed in claim 16, wherein the toner image is formed on the recording medium by one of development using a developing liquid or development using a dry developer.

19. A method of fixing a toner image on a recording medium by using a Johnson Rahbeck effect, wherein the Johnson Rahbeck effect is provided by a conductive electrode contacting a rear of the recording medium carrying the toner image on a front and a conductive member adjoining, but spaced from, said front such that a current flows between said conductive electrode and said conductive member via a gap.

20. A method as claimed in claim 19, wherein said conductive member is selected from the group consisting of a conductive roller and a conductive brush.

21. A method as claimed in claim 20, wherein the toner image is formed on the recording medium by a developing liquid.

22. A method as claimed in claim 20, wherein the current is derived from one of an AC voltage, a DC voltage, and an AC biased DC voltage.

23. A method of fixing a toner image formed on a recording medium, comprising the steps of:

(a) fixing the toner image temporarily on the recording medium by using a Johnson Rahbeck effect; and (b) fixing the toner image on the recording medium by fusion;

wherein step (a) comprises (c) causing a conductive electrode to contact a rear of the recording medium carrying the toner image on a front, (d) locating a conductive member in the vicinity of, but at a distance from, said front, and (e) causing a current to flow between said conductive electrode and said conductive member via a gap, whereby the Johnson Rahbeck effect is provided.

24. A method as claimed in claim 23, wherein said conductive member is selected from the group consisting of a conductive roller and a conductive brush.

25. A method as claimed in claim 24, wherein the toner image is formed on the recording medium by one of development using a liquid or development using a dry developer.

26. A method as claimed in claim 24, wherein in step (d) the current is derived from one of an AC voltage, a DC voltage, and an AC biased DC voltage.

27. A method of fixing a plurality of toner images sequentially formed on a single recording medium, comprising the steps of:

(a) fixing, by using a Johnson Rahbeck effect, each toner image temporarily on the recording medium every time the toner image is formed on the recording medium; and (b) fixing, after fixing a last toner image temporarily, all toner images on the recording medium by fusion;

wherein step (a) comprises (c) causing a conductive electrode to contact a rear of the recording medium carrying the toner image on a front, (d) locating a conductive member in the vicinity of, but at a distance from, said front, and (e) causing a current to flow between said conductive electrode and said conductive member via a gap, whereby the Johnson Rahbeck effect is provided.

28. A method as claimed in claim 27, wherein said conductive member is selected from the group consisting of a conductive roller and a conductive brush.

29. A method as claimed in claim 28, wherein the toner image is formed on the recording medium by a developing liquid.

30. A method as claimed in claim 28, wherein in step (d) the current is derived from one of an AC voltage, a DC voltage, and an AC biased DC voltage.

* * * * *